US006571476B1

(12) United States Patent
Bickers et al.

(10) Patent No.: US 6,571,476 B1
(45) Date of Patent: Jun. 3, 2003

(54) FOLDING DISPOSABLE RAZOR

(75) Inventors: James Luke Bickers, Las Vegas, NV (US); Cecil Boyce McCary, Las Vegas, NV (US)

(73) Assignee: Snappy Shave LLC., Henderson, NV (US)

( * ) Notice: Subject to any disclaimer, the term of this patent is extended or adjusted under 35 U.S.C. 154(b) by 62 days.

(21) Appl. No.: 09/779,251

(22) Filed: Feb. 7, 2001

Related U.S. Application Data

(60) Provisional application No. 60/180,983, filed on Feb. 8, 2000.

(51) Int. Cl.[7] ..... B26B 21/00
(52) U.S. Cl. ..... 30/47; 30/526
(58) Field of Search ..... 30/47, 50, 32, 30/526, 527, 532, 535

(56) References Cited

U.S. PATENT DOCUMENTS 4,439,920 A * 4/1984 Nauheimer ..... 30/47
4,485,554 A * 12/1984 Bergamaschi ..... 30/50
4,712,301 A * 12/1987 Saito ..... 30/47
4,985,994 A * 1/1991 Tavolieri ..... 30/47
6,082,006 A * 7/2000 Cahan ..... 30/47

* cited by examiner

*Primary Examiner*—Hwei-Siu Payer
(74) *Attorney, Agent, or Firm*—Jeffer, Mangels, Butler & Marmaro LLP

(57) ABSTRACT

A folding disposable razor is disclosed having a razor head and a flexible razor body attached to the razor head. The razor body preferably includes a first cover panel and second cover panel, each panel hingedly attached to an opposite end of a first hinge portion. In a storage configuration, the first cover panel and second cover panel fold relative to the first hinge portion such that the first and second cover panels are substantially parallel to each other and define a storage area therebetween. The first and second panels are preferably fastened together by interlocking members. The razor body also includes first, second and third section extending longitudinally along the razor body, the first and third sections hingedly attached at opposite ends of the second section. In an operating configuration, the first and third sections being folded relative to the second section such that the first and third sections form a razor handle.

1 Claim, 3 Drawing Sheets

FOLDING DISPOSABLE RAZOR

RELATED APPLICATIONS

This application is based on U.S. Provisional Patent Application Serial No. 60/180,983, filed Feb. 8, 2000, the disclosure of which is incorporated in its entirety herein by reference.

FIELD OF THE INVENTION

The present invention relates generally to disposable shaving devices and, more particularly, to a portable, folding disposable razor having a storage compartment therein.

BACKGROUND OF THE INVENTION

Disposable razors are commonly used because they are convenient and cost-effective. Because disposable razors are designed to be discarded after a certain number of uses, they are constructed of materials less expensive than those used in a non-disposable razor designed for permanent use. Currently, disposable razors account for a large percentage of total razor usage worldwide. Disposable razors are especially preferred in situations wherein the razor will be used for a single use only. Such situations include a hospital setting wherein a razor is used to prepare a patient for surgery and thereafter discarded for hygienic reasons. Disposable razors are also useful to travelers who wish to pack a lightweight portable razor that can be discarded after use.

Conventional disposable razors include a razor head, containing a blade or blades, a rigid, non-deformable razor handle permanently fastened to the razor head to form a single piece with the razor head, and a razor head cover for shielding the blade. There are many drawbacks associated with the conventional razors. For example, in a disposable razor, the razor head cover is not securely fastened to the razor and easily disengages from the razor exposing the blade. If the blade is exposed in the user's pocket, purse or travel bag, the user may be injured when he or she reaches in to retrieve the razor. Accordingly, there is a need for a disposable razor having a storage configuration wherein the blade is not exposed in a manner that could injure the user.

Additionally, when traveling, it is convenient to have a razor that is lightweight and not bulky thereby making it easy to fit in one's luggage. Conventional razors have a long, rigid, unbendable handle. The long handle facilitates the holding and maneuvering of the razor. However, the length of the handle is a disadvantage when packing because, to pack the razor, a traveler will need enough room to accommodate the length of the razor handle. Furthermore, the razor head is rigidly attached to the razor handle and protrudes therefrom. The packing space is required to be wide enough to accommodate the distance by which the razor head protrudes from the razor handle. Accordingly, there is a need for a portable, folding razor that has a full size, rigid handle in an operating configuration, yet folds into a compact case in a storage configuration for easy traveling.

In addition to the razor, the user must also carry shaving cream, which will require additional packing space. Shaving cream is traditionally stored in large cans that are bulky. It would be desirable to provide a razor that includes a storage area for carrying a single use packet of shaving cream therein.

In view of the above, a long felt need exists for a lightweight, disposable razor that is portable, includes a storage configuration, and does not have an exposed razor blade when not in use.

SUMMARY OF THE PREFERRED EMBODIMENTS

A folding disposable razor is disclosed having a razor head and a flexible razor body attached to the razor head. The razor body preferably includes a first cover panel and second cover panel, each panel hingedly attached to an opposite end of a first hinge portion. In a storage configuration, the first cover panel and second cover panel fold relative to the first hinge portion such that the first and second cover panels are substantially parallel to each other and define a storage area therebetween. The razor head is attached to a second hinge portion located opposite the first hinge portion. In a storage configuration, the first cover panel preferably extends over the razor head preventing the razor blade from being exposed. The first and second panels are preferably fastened together by interlocking members.

The razor body also includes first, second and third section extending longitudinally along the razor body, the first and third sections hingedly attached at opposite ends of the second section. In an operating configuration, the first and third sections being folded relative to the second section such that the first and third sections form a razor handle. The first and third sections are preferably fastened together in the operating configurtion, forming a rigid razor handle.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing modifications.

BRIEF DESCRIPTION OF THE DRAWINGS

The invention may be more readily understood by referring to the accompanying drawings in which.

Like numerals refer to like parts throughout the several views of the drawing.

DETAILED DESCRIPTION OF THE PREFERRED EMBODIMENTS

Referring to FIGS. 1–3 and 5, a preferred embodiment of a folding disposable razor 10 is shown. The folding disposable razor 10 generally includes first and second hinge portions 12, 14, first and second cover panels 16, 18 and a head portion 20.

Figure 1:
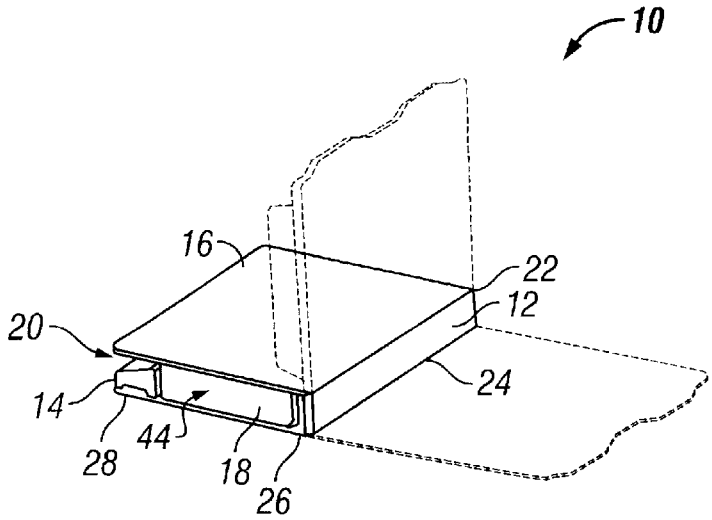
FIG. 1 is a perspective view of a preferred embodiment of the folding disposable razor of the present invention in its closed position, with the open and partially closed positions shown in phantom.
Figure 2:
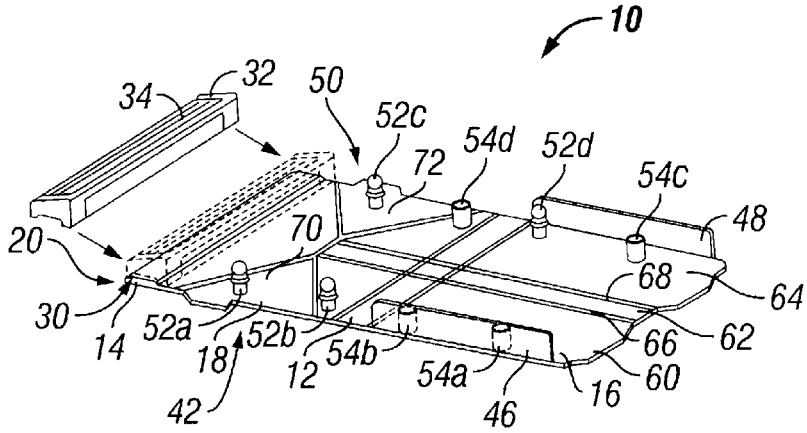
FIG. 2 is a perspective view of the folding disposable razor of FIG. 1 in its fully open position.
Figure 5:
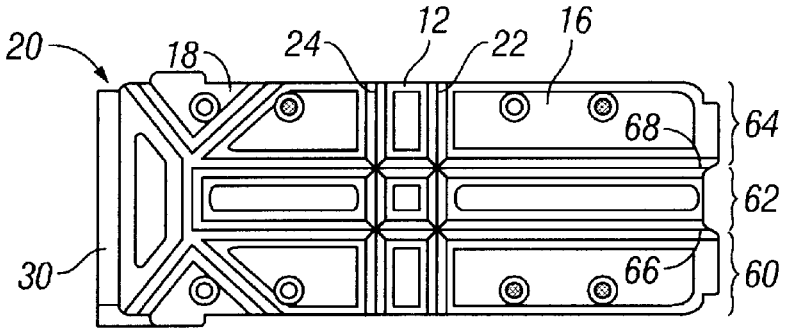
FIG. 5 is a top plan view of a preferred embodiment of the folding disposable razor of the present invention in its fully open position.

As best shown in FIGS. 1, 2 and 5, the first cover panel 16 is hingedly connected to the first hinge portion 12 along a first longitudinal edge 22. A first end 26 of the second cover panel 18 is hingedly connected to the first hinge portion 12 along a second longitudinal edge 24. The second longitudinal edge 24 is preferably opposite to the first longitudinal edge 22 to which the first cover panel 16 is connected. The second end 28 of the second cover panel 18 is preferably hingedly attached to the head portion 20 of the razor 10.

It will be understood that any method of forming a hinged connection known to those skilled in the art is within the scope of the present invention. For example, the pieces may be hingedly connected by a hinge or a thin piece of material that runs between the separate elements. In a preferred embodiment of the present invention, live hinges are used for hingedly connecting the first and second cover panels 16, 18 to the first hinged portion 12 and for connecting the second cover panel 18 to the second hinged portion 14. Live hinges are used herein to refer to a flexible joint formed in the material from which the hinge portions 12, 14 and the cover panels 16, 18 are composed wherein the live hinges operate to connect the hinge portions and cover panels and allow for the movement of the cover panels 16, 18 relative to the hinge portions 12, 14.

Head portion 20 preferably includes a base member 30 and a blade assembly 32 mountable on the base member 30. The blade assembly 32 includes a razor blade 34 secured therein as is known in the shaving art. In a preferred embodiment of the invention, the blade assembly is configured to slidably engage the base member 30. When the razor is in use, the blade assembly 32 is securely retained on the base member 30.

Figure 3:
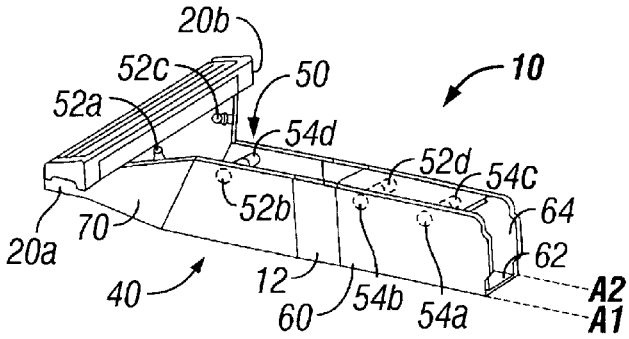
FIG. 3 is a side elevational view of the folding disposable razor of FIG. 1 in its operating configuration.

The folding disposable razor 10 of the present invention includes a storage configuration, as shown in FIG. 1 and an operating configuration, as shown in FIG. 3. In the operating configuration, as shown in FIG. 3, razor 10 has a full size, rigid handle 40 that is easy to grip and maneuver in the shaving process. In the storage configuration, as shown in FIG. 1, the razor 10, including the handle 40, folds into a compact case for easy storage and traveling. The operating and storage configurations are discussed in further detail below.

Figure 8:
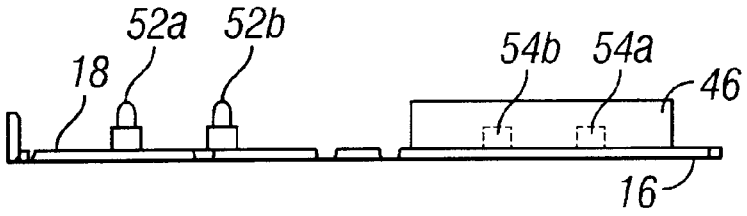
FIG. 8 is a side elevation view of the disposable razor of the FIG. 5.

From the open position, as shown in FIGS. 2 and 5, the folding disposable razor 10 can be folded into the storage configuration, shown in FIG. 1, in the following manner. The head portion 20 is urged toward the body 42 of the razor 10. Because the head portion 20 is hingedly attached to the second hinge portion 14, there is sufficient flexibility to allow the head portion 20 to be urged toward the razor body 42 in the storage configuration. Next, the first cover panel 16 is pivoted, as shown in FIG. 1, until the first cover panel 16 is substantially parallel to the second cover panel 18. The first cover panel 16 is pivoted approximately 180 degrees which results in the first hinge portion 12 pivoting approximately 90 degrees. The first and second cover panels 16, 18 define a storage area 44 therebetween. To further enclose the storage area 44, a first flange 46, as best shown in FIGS. 1, 2 and 8, is disposed between the first cover panel 16 and the second cover panel 18 when the razor 10 is in a storage configuration. A second flange 48, as best shown in FIGS. 1, 2 and 9 is provided between the first cover panel 16 and second cover panel 18, distal from the first flange 46.

Figure 9:
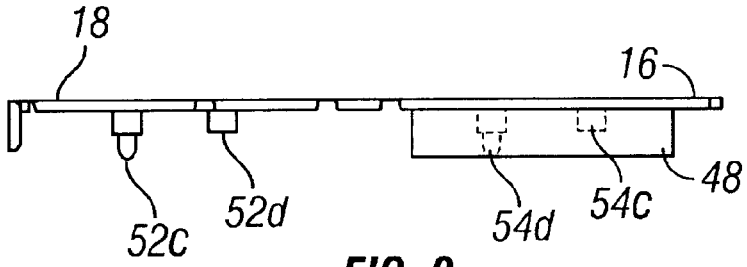
FIG. 9 is a side elevation view of the disposable razor of FIG. 5 in an inverted position.

In the embodiments shown in FIGS. 2, 8 and 9, the first and second flanges 46, 48 extend from the first cover panel 16. However, the flanges 46, 48 can, in the alternative, extend from the second cover panel 18 or from the first hinge portion 12. In yet another embodiment of the invention, each of the first and second hinge portions 12, 14 and the first and second cover panels 16, 18 include flanges that extend upwardly therefrom and run along the outside edges thereof. The flanges are configured such that when the razor 10 is in a storage configuration, the flanges substantially cover the gap between the first cover panel 16 and the second cover panel 18.

The storage area 44 is enclosed by the first and second panel 16, 18, the first and second hinge portions 12, 14 and the first and second flanges 46, 48. If an item is placed. in the storage area 44 it will be contained within the storage area 44 while the razor 10 is in a storage configuration. In a preferred embodiment of the invention, the storage area 44 is dimensioned to store a single use portion of shaving cream. Accordingly, in addition to folding into a compact size for easy storage and travel, the folding disposable razor 10 of the present invention provides a convenient storage area for carrying the shaving cream to be used in conjunction with the razor in the shaving process.

To retain the razor 10 in a storage configuration, razor 10 preferably includes interlocking members, collectively referred to as 50, for engaging the first cover panel 16 with the second cover panel 18. In a preferred embodiment of the invention, the interlocking members 50 include a latch member 52 and a latch receiver 54 that mate together to engage the interlocking members 50. In a more preferred embodiment of the invention, the latch member 52 is a detent that positions and holds the latch receiver 54 until the engagement is release by force applied to the interlocking members 50. It will be understood that latch member 52 and latch receiver 54 can be any combination of elements used for temporarily affixing two mechanical parts together. For example, latch member 52 can be received via a friction fit into latch receiver 54 or latch member 52 and latch receiver 54 can be complementary buttons, Velcro pieces, snaps, adhesives or the like.

Figure 7:
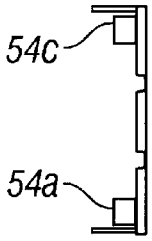
FIG. 7 is an end view of the disposable razor of the FIG. 5.

The operating configuration of a preferred embodiment of the present invention is now described. From the open position, shown in FIG. 2, the razor 10 can be folded into an operating configuration, as shown in FIG. 3. As best shown in FIGS. 2 and 7, the first and second cover panels 16, 18 and the first hinge portion 12 cooperate to form first section 60, second section 62 and third section 64. The first section 60 is hingedly attached to a first end 66 of the second section 62 and the third section 64 is hingedly attached to a second end 68 of the second section 62. In a preferred embodiment of the invention, live hinges are used for hingedly connecting the first and third section 60, 64 to the second section 62. It is to be understood, however, that the hinged connection can be formed using any method known to those skilled in the art including connection by a hinge or a thin piece of material that runs between the separate elements.

To fold the razor 10 into its operating configuration, the first and third sections 60, 64 are folded relative to the second section 62 to form a handle 40. In a preferred embodiment of the invention, the first and third sections 60, 64 are folded relative to the second section 62 along substantially parallel longitudinal axes A1, A2 until the first and third sections 60, 64 are substantially parallel to each other.

In a preferred embodiment of the invention, the razor 10 includes at least one pair of interlocking members 50 for connecting the first section 60 with the second section 62 and securely maintaining the form of a razor handle 40 when the razor 10 is in an operating configuration. In the embodiment shown in FIGS. 2 and 3, the razor includes latch members 52 and latch receivers 54 that engage to keep the first section 60 and third section 64 substantially parallel to each other. The flanges 46, 48 disposed on the first cover panel 16 are preferably positioned such that they will not interfere with the operation of the interlocking members 50. In the embodiment shown in FIG. 3, the first flange 46 overlaps the second flange 48 when the razor 10 is in an operating configuration, thereby allowing the interlocking members 50 to engage.

Figure 6:
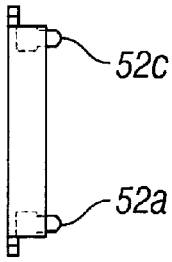
FIG. 6 is an end view of the disposable razor of the FIG. 5.

In a preferred embodiment of the invention, the same interlocking members 50 are used for engagement of the razor in both the storage configuration and the operating configuration. For example, in the embodiment shown in FIGS. 2, 6 and 8, two latch members 52*a*, 52*b* are located on the second cover panel 18 corresponding with two latch receivers 54*a*, 54*b* located on the first cover panel 16, respectively. Similarly, on the opposing side of the second cover panel 18, as shown in FIGS. 2, 7 and 9 are a latch member 52*c* and a latch. receiver 54*d* corresponding to a latch receiver 54*c* and a latch member 54*c* located on the first cover panel 16. In a storage configuration, latch members 52*a* and 52*b* engage latch receivers 54*a* and 54*b*, respectively. Similarly, latch member 52*c* engages latch receiver 54*c* and latch member 52*d* engages latch receiver 54*d*. When all latch members engage the latch receivers, the razor is securely fastened in a storage configuration.

The same latch members and receivers can be used to securely fasten the razor in an operating configuration. In the operating configuration, as shown in FIG. 3, latch member 52*b* engages latch receiver 54*d* and latch member 54*b* engages latch receiver 52*d* to securely fasten the first section 60 to the third section 64 and maintain a sturdy razor handle 40 to be gripped by the user. In the embodiments shown in FIGS. 1–3, the latch members are detents that position and hold the latch receivers 54 until the engagement is released by force applied to the interlocking members in a direction separating them. However, it will be understood that latch member 52 and latch receiver 54 can be any combination of elements used for temporarily affixing two mechanical parts together. For example, latch member 52 can be received via a friction fit into latch receiver 54 or latch member 52 and latch receiver 54 can be complementary buttons, Velcro pieces, snaps, adhesives or any other fastening devices known in the art.

The second cover panel 18 preferably includes support sections 70, 72 that are positioned in a mirror relationship to each other. The support sections 70, 72 are configured such that when the razor 10 is in an operating configuration, the support sections 70, 72 extend outward from the razor handle 40 to the outer edges 20*a*, 20*b*, respectively, of the razor head portion 20. In an operating configuration, the support sections 70, 72 support the razor head portion 20 and prevent the head portion 20 from undesired movement during the shaving process.

The razor 10 is preferably made of a material that is durable, such as metal or plastic. In a more preferred embodiment of the invention, the disposable razor 10 is made of a plastic material that is sufficiently rigid to form interlocking members and a rigid razor handle, yet sufficiently pliable to be foldable along the hinged areas.

Figure 4:
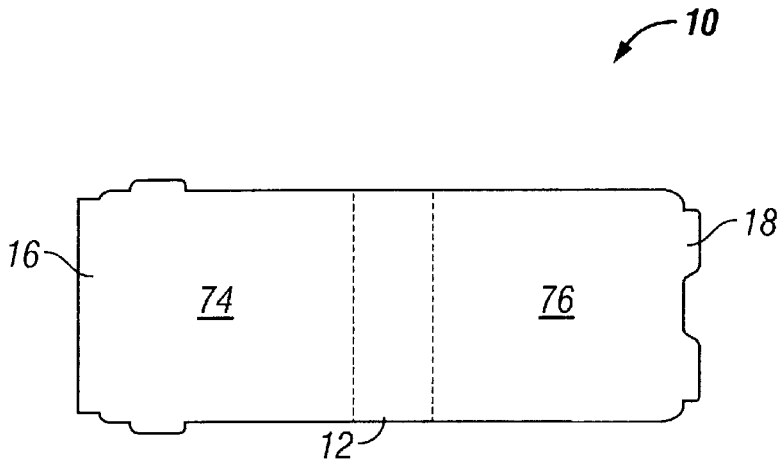
FIG. 4 is a back view of the folding disposable razor of FIG. 1 in its open position.
Figure 10:
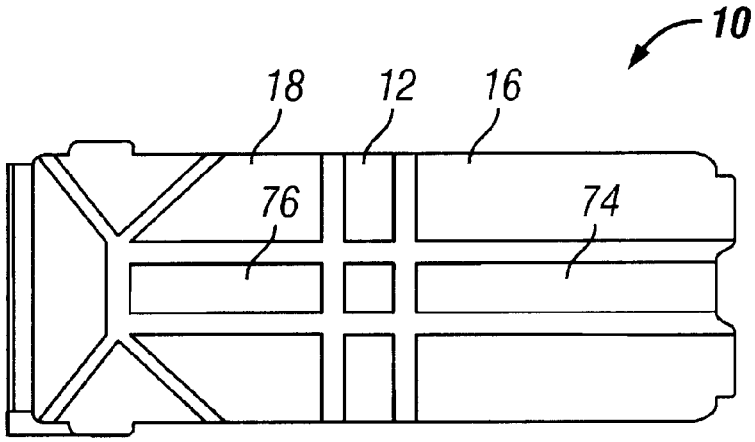
FIG. 10 is a bottom plan view of the disposable razor of FIG. 5.

When the razor is in a storage configuration, the blade assembly is covered by a portion of the first cover panel 16, thus ensuring that a user will not be injured by an exposed razor blade. The first and second cover panels 16, 18 are preferably substantially planar, allowing one to stack the razors one on top of the other when the razors are in a storage configuration. The ability to store the razors on top of each other is ideal for applications such as hospitals wherein a large quantity of razors are kept in inventory and require an orderly storage. Also, the planar cover panels 16, 18 are ideal for positioning a label thereon. FIGS. 4 and 10 depict the back view of the first and second cover panels 16, 18. Each of the panels 16, 18 defines a label area 74, 76 thereon. The label area 74, 76 can be used to display advertising, a logo, instructions for assembling and using the folding razor or any other information. If advertisement is placed in the label area 74, 76, the folding disposable razor 10 can be used as a marketing tool. Companies that desire to advertise their names or products can provide disposable razors bearing a logo or a message to users.

As discussed above, the storage area 44 of the razor can store a single use portion of shaving cream to eliminate the need for a user to carry shaving cream separately from the razor. To use the invention, the interlocking members 50 are disengaged, the razor body 42 is unfolded and the packet of shaving cream is removed therefrom. The razor 10 is folded into an operating configuration and the interlocking members are again engaged. The shaving cream is applied and the razor is used, as with other known razors, to shave the desired area.

It is envisioned that this product would be especially useful for preparing patients for surgery. The shaving cream and razor can be provided as a unit. The handle provides sufficient stability to ensure a safe shave and the entire unit can be disposed after a single use. In addition to the medical field, the present invention can be used as an amenity provided by the hotel industry. Its compact design is desirable for travelers and for military personnel who are not afforded much room for packing personal items. The list of uses for the present invention is not exhaustive and there are numerous other applications for which the disposable folding razor could be used.

The embodiments of the present invention are intended to be merely exemplary and those skilled in the art will be able to make numerous modifications to them without departing from the spirit of the present invention. For example, the razor blade may be angled for shaving or for cutting. The second hinged portion or the second section 62 may be omitted. All such modifications are intended to be within the scope of the present invention as defined by the claims appended hereto.

What is claimed is:

1. A disposable shaving kit, comprising:

a razor body, wherein the razor body includes a first hinge portion having a first end and a second end distal the first end, a first cover panel hingedly attached to the first end of the first hinge portion, a second cover panel hingedly attached to the second end of the first hinge portion;

a razor head connected to the razor body;

a storage configuration, wherein in the storage configuration, the razor body defines a storage area, in the storage configuration, the first cover panel and second cover panel being substantially parallel to each other defining the storage area therebetween;

an operating configuration, wherein in the operating configuration, the razor body forms a razor handle; and a plurality of fasteners, the fasteners connecting the first and second cover panels to each other, wherein the plurality of fasteners comprise a first male interlocking member on the second cover panel corresponding to a first female interlocking member on the first cover panel;

a second male interlocking member on the second cover panel corresponding to a second female interlocking member on the first cover panel;

a third male interlocking member on the second cover panel corresponding to a third female interlocking member on the first cover panel; and a fourth female interlocking member on the second cover panel corresponding to a fourth male interlocking member on the first cover panel;

wherein in the storage configuration, the first, second, third and fourth male interlocking members engage with the first, second, third and fourth female interlocking members, respectively; and wherein in an operating configuration, the second male interlocking member engages with the fourth female interlocking member and the second female interlocking member engages with the fourth male interlocking member.

* * * * *